US005416257A

United States Patent [19]

Peters

[11] Patent Number: 5,416,257

[45] Date of Patent: May 16, 1995

[54] OPEN FROZEN BARRIER FLOW CONTROL AND REMEDIATION OF HAZARDOUS SOIL

[75] Inventor: Raymond P. Peters, Pittsburgh, Pa.

[73] Assignee: Westinghouse Electric Corporation, Pittsburgh, Pa.

[21] Appl. No.: 198,758

[22] Filed: Feb. 18, 1994

[51] Int. Cl.[6] ..... G21F 9/04

[52] U.S. Cl. ..... 588/1; 588/20; 62/45.1; 405/52; 405/80; 405/128; 405/130

[58] Field of Search ..... 588/17, 1, 20; 405/128, 405/130, 52, 80; 62/45.1

[56] References Cited

U.S. PATENT DOCUMENTS

| | | | |
|---|---|---|---|
| 3,183,675 | 5/1965 | Schroeder | 405/130 |
| 3,267,680 | 8/1966 | Schlumberger | 405/130 |
| 3,559,737 | 2/1971 | Ralstin | 166/281 |
| 4,597,444 | 7/1986 | Hutchinson | 166/302 |
| 4,778,628 | 10/1988 | Saha et al. | 405/128 |
| 4,860,544 | 8/1989 | Krieg et al. | 62/45.1 |
| 4,966,493 | 10/1990 | Rebhan | 405/128 |
| 4,974,425 | 12/1990 | Krieg et al. | 62/45.1 |
| 5,050,386 | 9/1991 | Krieg et al. | 62/45.1 |
| 5,324,137 | 8/1994 | Dash | 405/128 |

OTHER PUBLICATIONS

Iskander, "Effect of Freezing on the Level of Contaminants in Uncontrolled Hazardous Waste Sites," Special Reports 86-19, U.S. Army Corps of Engineers, pp. 1-33.

Sullivan, Jr. et al., "Comparison of Numerical Simulations with Experimental Data for a Prototype Artificial Ground Freezing," Proceedings of the International Symposium on Frozen Soil Impacts on Agriculture, Range, and Forest Lands, Special Report 90-1, pp. 36-43.

*Primary Examiner*—Ngoclan T. Mai

*Attorney, Agent, or Firm*—Daniel P. Cillo

[57] ABSTRACT

Treatment of flowable underground contaminants comprises freezing at least one open underground barrier volume to form a wall (10) near the contaminated region (12) in the ground (14), where the wall (10) is positioned to direct the contaminant flow (16) along a subsurface path (18) and allow concentration of the contaminants and their remediation.

13 Claims, 4 Drawing Sheets

FIG. 1
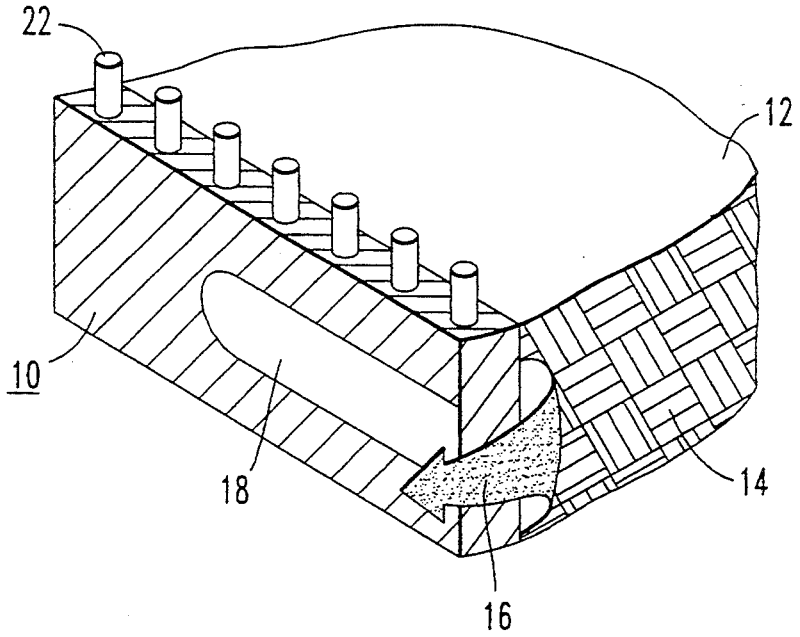
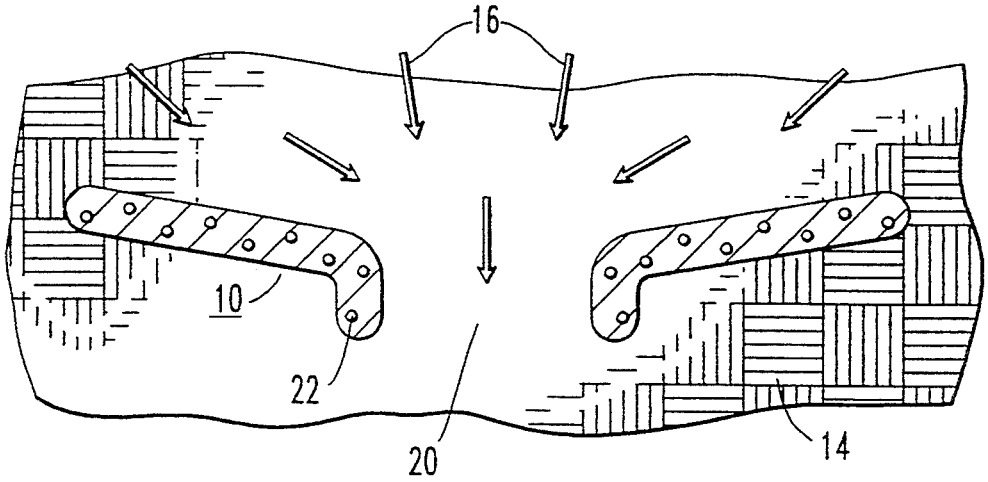
FIG. 2

OPEN FROZEN BARRIER FLOW CONTROL AND REMEDIATION OF HAZARDOUS SOIL

FIELD OF THE INVENTION

This invention relates to the use of open, frozen barriers to control the direction and rate of migration of toxic or nuclear contamination in the earth, and then to remediate the hazardous or nuclear content at an area of directed concentration.

BACKGROUND AND SUMMARY OF THE INVENTION

Toxic or nuclear contamination of soil and its migration within the soil is a continuing threat to the environment, particularly the water supply. The contamination could result from surface spills, pesticide spraying, disintegration of metal containers of discarded chemicals or oils buried in the ground, nuclear accident, and general industrial neglect in disposal of solvents, polychlorinated biphenyls (PCB's) and other commercial waste.

U.S. Pat. No. 4,778,628 (Saha et al.) describes an underground waste barrier structure constructed by forming a recessed area within the earth, lining the recessed area with an outer layer of clay, a middle layer of zeolite and an inner layer of activated carbonaceous material into which the waste, in the form of 55 gallon steel drums containing toxic material can be placed. A ceiling is then formed of the layer materials, and the whole covered with earth. This and other similar methods did not address problems of free, in-situ toxic or nuclear contamination in the soil.

In U.S. Pat. No. 3,559,737 (Ralstin et al.) a method to limit or control leakage or spill conditions in volatile hydrocarbon fuel storage reservoirs in the earth is discussed. Here, localized, in-situ freezing is used to form an impervious cryogenic structure in caprock fractures and frozen barriers in topographical saddle regions. A series of wells are drilled to provide a line of wells through which refrigerant is circulated to freeze the earth and form frozen sections; using techniques developed earlier, for forming frozen containment barriers to enclose storage reservoirs, and for forming frozen foundations within the ground, as taught in U.S. Pat. Nos. 3,183,675 (Schroeder) and 3,267,680 (Schlumberger), respectively. Using similar technologies, U.S. Pat. No. 4,597,444 (Hutchinson) teaches freezing an entire volume of soil about oil recovery shafts drilled into the earth, to prevent collapse of the shaft sides, by using refrigerant injecting shafts at selected distances outside the diameter of the oil recovery shaft.

In U.S. Pat. Nos. 4,860,544; 4,974,425; and 5,050,386 (all Krieg et al.) all the prior techniques were used to provide a method for complete containment of hazardous material in the ground, such as gasoline, oil, PCB's, radioactive isotopes, or a garbage dump, by providing an enclosing, flow-impervious cryogenic barrier. These patents teach an array of boreholes extending downward from spaced apart locations on the periphery of the containment site. A flow of refrigerant medium is established in the barrier boreholds whereby water in the portions of the Earth adjacent to the barrier boreholes freezes to establish ice columns extending radially about the boreholes. The lateral separations of the boreholes and the radii of the ice columns are selected so that adjacent ice columns overlap. The overlapping ice columns collectively establish a closed, flow-impervious barrier about the predetermined volume underlying the containment site. The main embodiment utilizes a subterranean, frozen, Vee shaped trough barrier extending into and through subsurface layers below ground level.

The Vee shaped trough barrier taught by Krieg et al. is enclosed on all sides except the top, to completely underlie, encompass, and trap the hazardous material in a manner to allow no natural flow of water into or out of the contained ground. A gas pressure test is used to confirm that the barrier is complete. In the case where there is a shallow fluid-flow impervious sub-stratum, the cryogenic fluid pipes need not converge but may extend from spaced apart locations on the perimeter of the containment surface to that sub-stratum establishing a completely closed "picket fence" like ring of pipes to fully enclose the hazardous volume. Contaminant tends to collect at the bottom of the encompassing barrier where it may be pumped out if desired.

In another embodiment of the Krieg et al. inventions, a predetermined volume within the containment system is frozen, while other predetermined volumes are kept unfrozen in a manner such that a frozen cell portion can be lifted out of the ground from its in-situ position. This cell can be sprayed with water to establish an ice glaze on all sides, to prevent hazardous material on the cell periphery from becoming windborne, after which the cell can be removed from the site. This process of hazardous material removal would involve moving large volumes of earth.

There are instances where it is advantageous not to completely enclose a mass of hazardous material in the ground, but rather direct flow of the hazardous material with groundwater in a controlled manner to concentrate the hazardous material at a remote location for further treatment, without massive earth removal. It is one of the objects of this invention to provide such a method of controlled flow, concentration and treatment.

Accordingly, the invention broadly resides in a method of treating flowable contaminants beneath a surface region in the ground, characterized by freezing at least one, open subsurface barrier volume of earth in the form of a wall structure near the contaminated region, and positioning the frozen barrier such that the flow of contaminants is directed along a predetermined, subsurface path, causing concentration of contaminants. The barrier can be a single wall of frozen earth, a plurality of walls of frozen earth directing a flow of contaminants between them, a partly surrounding connecting walled structure, or the like. The barrier is frozen by techniques well known in the art, such as using closely spaced concentric pipes to pump or otherwise pass and recycle a refrigerant medium through the ground within the volume of earth where the frozen barrier is desired. The circulating refrigerant removes heat from the ground around the pipes and forms cylinders of frozen ground, which cylinders eventually join without any gaps to form a wall of frozen ground.

The invention additionally resides in a method of treating flowable contaminates beneath a surface region in the ground, characterized by: (A) freezing a subsurface barrier volume of earth having two end portions and a central portion partly surrounding the contaminated region and vertically extending to an impervious strata layer; (B) positioning the frozen barrier to allow a flow of contaminants within the subsurface barrier through an opening between the two end portions of the barrier in a manner to concentrate the contaminants; and (C) concentrating the contaminants. In one embodiment, the flow of contaminants will be from inside the barrier, and through a narrow concentrating opening between the two end portions, to a point outside the barrier. In another embodiment, the flow of contaminants will be toward the central portion of the barrier and between a wide opening between the two end portions to cause concentration near the central portion. A variety of remediation means, such as resin columns, electrokinetic anodes and cathodes, and the like can be disposed within the concentration side and a variety of chemicals can be pumped into, or water pumped out of the contaminated subsurface volume.

This method of this invention has the advantages of both directing and concentrating contaminates while actively and efficiently performing remediation. The contaminants will usually be in the form of hazardous or nuclear contaminants. The ability to direct contaminant migration with frozen barriers provides the means to make feasible large scale remediation which heretofore has been impractical, uncontrollable, and prohibitively expensive. By utilizing this application, the subsurface contamination can be redirected from a sensitive area, such as an aquifer, river, or stream, etc. and then remediated in a capture zone. This is extremely important, for example, in controlling a plume. The redirection of subsurface contaminants is possible because the diffusion rate of hazardous and nuclear contaminants through frozen soil barriers is extremely low. Frozen barriers also provide a flexible, economical, and removable method to effectively direct the path of contaminants in the earth and have the added feature of being self-healing.

Conventional cryogenic approaches to containment are limited in their approach: they either form a "bathtub" around the contaminated area with an array of vertical and slanted freeze pipes, or they form a completely enclosing vertical wall with freeze pipes in a "picket fence" arrangement when there is an impervious soil layer close to the surface around the contaminated area. In either case, the conventional approach is to form a totally closed barrier around the entire periphery of the contaminated site.

There are a significant number of applications where it is unnecessary and/or uneconomical to totally enclose a contaminated volume, as taught in the prior art, to achieve effective containment. For example, topographical and subsurface soil conditions may exist such that there may be a relatively shallow unconfined aquifer spread over a large area that discharges groundwater to a stream. To achieve effective containment, a frozen barrier along the stream would be sufficient to control contaminant migration as long as the upstream groundwater was eliminated with wells or some type of drainage system. Simultaneously, remediation technologies could be directed at the containment area, such as electrokinetics with a recycle system to inject lixiviants or a pump and treat system. Similarly, many of the government burial grounds contain unlined trenches. In order to excavate these trenches (where there may or may not be contained water) which usually parallel one another, a frozen barrier that acts as a retaining wall, prevents hazardous/nuclear cross contamination, minimizes excavation, and is an ideal short term application for an open frozen barrier.

Other examples of applications of this invention include remediation efforts entailing excavation of the contents of a particular trench in a group of trenches where there is very shallow impermeable bedrock that is, for instance, located downgrade along a slope. It would only be necessary to construct a frozen barrier around three sides of the trench to the impermeable layer, since the contents would be recovered from the fourth, and uphill, side. This invention can be utilized in numerous other applications to contain contaminant plumes in sites not currently addressed by existing frozen, "closed barrier" barrier technology, such as long sloping sites where groundwater must be controlled or large areas where perhaps there are burial trenches in sloped sites containing groundwater.

BRIEF DESCRIPTION OF THE DRAWINGS

In order that the invention can be more clearly understood, convenient embodiments thereof will now be described, by way of example, with reference to the accompanying drawings in which:

FIG. 1 is a cross-sectional isometric view, showing flowing hazardous contaminants in the ground and one embodiment of a frozen, subsurface barrier wall structure, near the contaminated region, positioned to direct the flow of contaminants in a controlled fashion;

FIG. 2, which best illustrates the invention, is a cross-sectional view of two frozen, subsurface barrier wall structures directing a flow of hazardous contaminants between them to allow concentration outside of the barrier;

DESCRIPTION OF THE PREFERRED EMBODIMENTS

Figure 3:
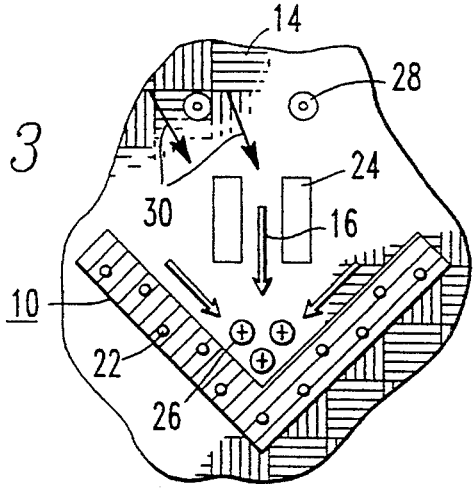
FIG. 3 is a cross-sectional view of another embodiment of a frozen, subsurface barrier wall structure directing and concentrating hazardous contaminants, from several burial trenches to a point where remediation means are placed.

Referring now to FIG. 1 of the drawings, an open, subsurface barrier volume of earth, in the form of wall structure 10, is shown near a region 12 which is contaminated. The contaminants may be hazardous and/or nuclear contamination, which contamination is flowable beneath the region 12 in the ground 14. The wall structure 10 is in the form of a frozen barrier, and is positioned such that the flow 16 of contaminants, shown by the arrow, is directed along a generally horizontal, subsurface path 18, to allow concentration of contaminants. By "generally horizontal" is meant a flow path of least resistance as influenced by the frozen barrier. FIG. 2, utilizing at least two wall structures 10, in the form of frozen barriers, better shows how subsurface flow 16 of contaminants is directed to allow concentration, as at location 20, usually outside the frozen barrier wall structure 10. In all cases, freeze pipes 22 are used to form the frozen barrier. These freeze pipes can be disposed in straight or slightly offset positions and in one or more lines to form the frozen barrier.

The frozen wall structure will, in all cases, be frozen earth or dirt. This requires no excavation to pour concrete or the like, and when remediation is completed the frozen volume can be allowed to return to its normal temperature, with complete healing. Since the diffusion rate of hazardous and/or nuclear contamination into or through earth or dirt held at a temperature below −20° C. is extremely low, as taught by diffusion theory, such volume should have minimal contamination when it is returned to its normal temperature, but while frozen, is particularly effective to direct the flow of hazardous and/or nuclear contamination in the ground.

The hazardous or nuclear contamination can be in the form of liquids from surface spills, residues from pesticide spraying, liquids from disintegration of metal containers of chemicals or oils buried in the ground, residues from general industrial neglect in disposal of solvents, PCB's, trichloroethylene or other commercial waste, materials leached from concrete waste containers, or nuclear accident. Once such contamination is in the ground in either solid or liquid form, rainwater and subterranean water flow, leaches, dissolves and incorporates such contaminated material into the natural subterranean water flow pattern causing rapid spread of the contamination. Contaminants migrate in accordance with the topography and hydrogeology below the surface of the earth, and proceed due to a difference in pressure head, usually in a natural flow path, such as saddle regions, fracture systems in underlying strata, and in porous aquifer zones such as sandstone located between or above relatively impervious rock formations.

This invention encompasses the application of open frozen barriers. The deployment of this application will usually require the use of a refrigeration system, heat exchanger, and freeze pipes 22, all of which are commonly used in civil engineering applications. The refrigeration system provides cooling in a heat exchanger to the working fluid, which is usually a brine or glycol mixture. The working fluid temperature is cooled below freezing by a refrigeration system and then circulated by means of a pump to freeze pipes that have been installed in the earth.

These freeze pipes are about 10 cm to 20 cm (4 inches to 8 inches) in outside diameter and are actually a "pipe within a pipe". The working fluid is circulated down the outer annulus of the freeze pipe and returned to the heat exchanger through the inner pipe in a continuous closed loop system. The circulating refrigerant removes heat from the strata around the freeze pipes and forms cylinders of frozen ground which join up, if the freeze pipes are properly placed, without any gap to form a continuous subsurface wall of any specified thickness depending upon the number and configuration of freeze pipe emplacements. The freeze pipes are usually disposed vertically, but can also be disposed at any angle suitable to the underground topography.

FIG. 3 shows an embodiment where concentration is effected at a location inside the frozen barrier wall structure 10. Also shown are burial trenches 24 from which the contaminants are flowing, and remediation means 26 which are placed in the ground at or near the point of concentration 20, in order to remove the contaminants. The remediation means 26 can be: electrokinetic remediation using electrostatic techniques consisting of ion exchange by means of charged anodes and cathodes where large molecules are retained and recovered, and $H^+$ and $O^2$ allowed to pass; resin and/or zeolite columns using ion exchange techniques where large molecules are retained and recovered, and $H^+$ and $O^{2-}$ are allowed to pass; tubular reverse osmosis techniques where $H^+$ and $O^{2-}$ would pass through a semipermeable membrane and large molecules are retained and recovered; or any other number of chemical separation, mechanical separation or other techniques. A series of water withdrawal wells 28 associated with the frozen barrier wall structure 10 and in the middle of ground water flow, shown by broken arrows 30, can be used to depress the water table of the groundwater and minimize the pressure head driving of the flow of contaminants.

Figure 4:
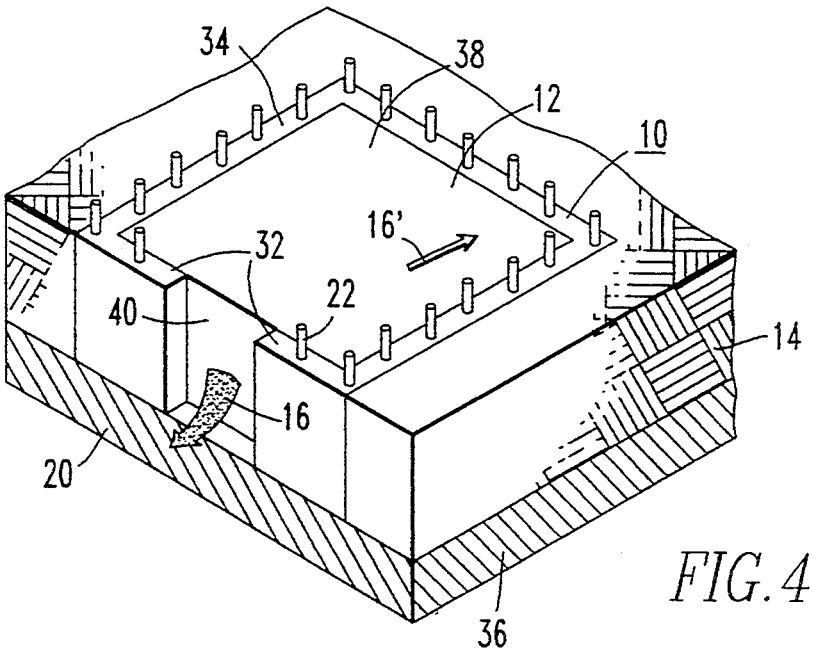
FIG. 4 is a cross-sectional isometric view showing hazardous contaminants in the ground, flowing either into or out of another embodiment of an open, frozen, subsurface barrier wall structure having two end portions and a central portion with an opening between the two end portions, the whole resting on impervious strata.

FIG. 4 shows another embodiment of the subsurface barrier of this invention, where, the frozen barrier wall structure 10, while a single wall, has two end portions 32 and a central portion 34 partly surrounding the contaminated region 12 in the ground 14. Here, and also in all the previous embodiments, the barrier wall structure 10 can and in many cases preferably will vertically extend to the top of an impervious strata layer 36.

Figure 5:
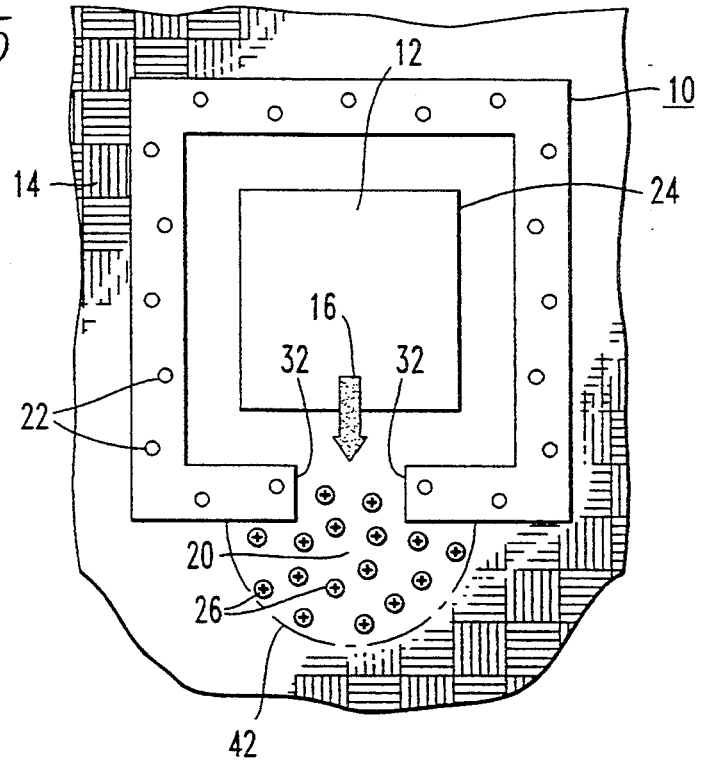
FIG. 5 is a cross-sectional view of the barrier structure of FIG. 4, additionally showing a burial trench, and remediation means at the point of concentration of the contaminants.

As shown in FIG. 4, the flow 16' of contaminants can be within the subsurface barrier to concentrate at location 38 within the barrier from the outside; or the flow 16 of contaminants can be within the subsurface barrier to concentrate at location 20 outside the barrier. The narrow concentration opening 40 can be along the entire vertical length between the two end portions 32 or in some instances, where for example a reverse osmosis membrane may be utilized between the two end portions. The freeze pipes are shown as 22. A cross-sectional view of this embodiment is shown in FIG. 5, also showing a burial trench 24 from which contaminants may be flowing, as well as remediation means 26, such as the electrokinetic remediation means described previously, in the opening 40 and outside that opening in a capture zone defined by the dashed line 42.

Referring now to the embodiment shown in FIG. 6, again, a frozen barrier wall structure 10 is shown with two end portions and a central portion partly surrounding the contaminated region 12 in a burial trench 24 in the ground 14. Here, in addition to remediation means 26 within capture zone 42, a chemical addition tank 44 is used to pump chemicals into the contaminated region 12, within the frozen barrier, in an amount effective to enhance contaminant migration through the soil. These chemicals are fed by pump 46 through line(s) 48 into chemical addition wells 50. A wide variety of chemicals can be used, depending on the contaminant(s) involved, for example, electrolytes or other complexing agents can be used to enhance migration of the subsurface contaminants.

Figure 6:
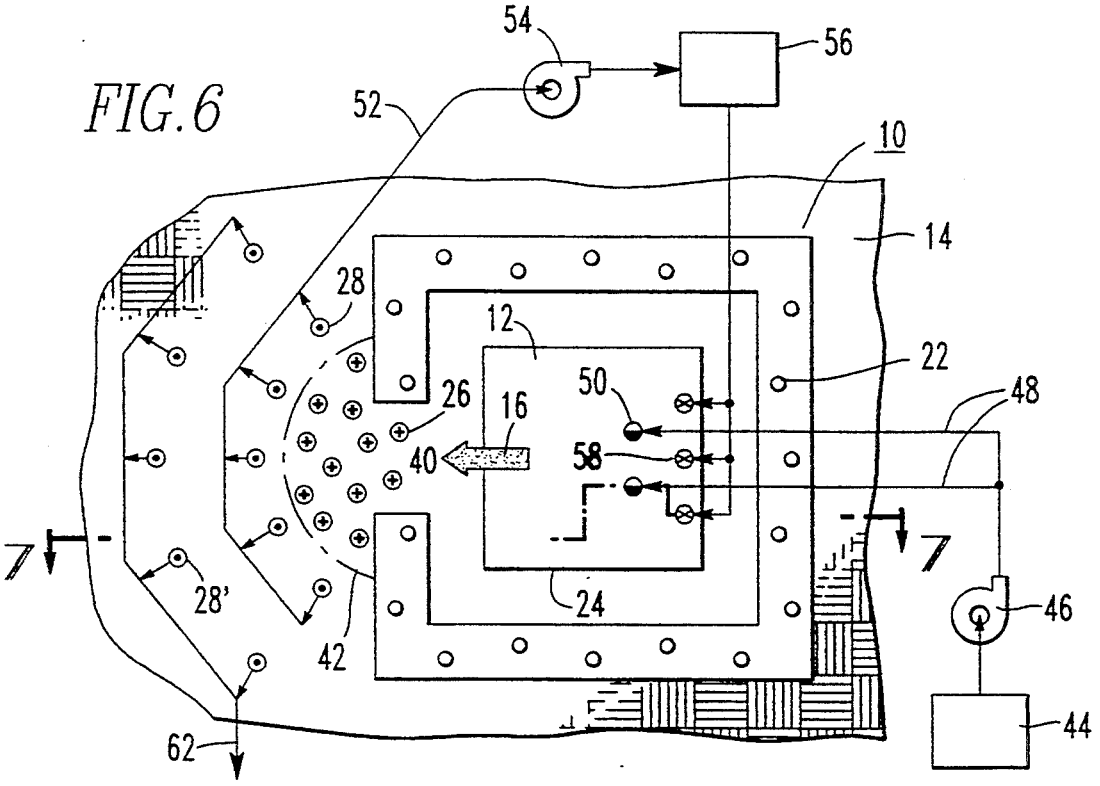
FIG. 6 is a cross-sectional view of a remediation site, showing hazardous contaminate flow from a burial trench out of an open, frozen, subsurface barrier wall structure, and additionally showing chemical addition wells, groundwater injection wells, recycle wells, backflow prevention wells, and remediation means at the point of concentration of the hazardous contaminants.

Groundwater is also extracted in the embodiment shown in FIG. 6, by means of water withdrawal wells 28 located immediately downstream of the capture zone 42. The groundwater is recycled by line 52 and pump 54 to recycle tank 56, where the groundwater can be stored or injected through groundwater injection wells 58 upstream of the capture zone at a controlled rate to cause contaminant flow. The stream of contaminants and flow is shown as 16. The pressure head induced by the injection wells will enhance contaminant migration for remediation.

Figure 7:
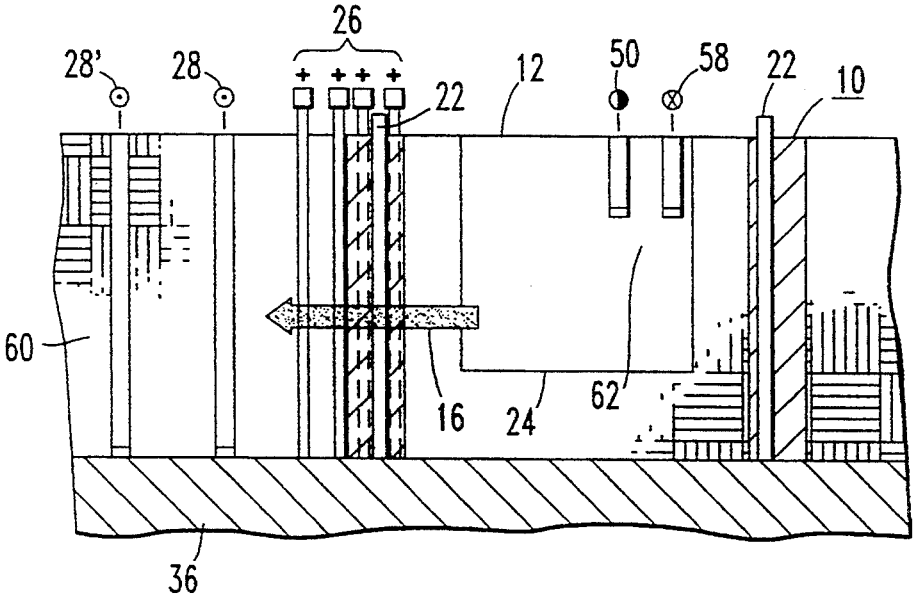
FIG. 7 is a cross-sectional view along line VII—VII of the open barrier structure of FIG. 6 and associated wells and remediation means.

Another set of water withdrawal wells 28' further downstream, that is downstream from flow 16, from the first set 28, can be used to prevent back flow of water from point or area 60, counter to flow 16 into opening 40. This water can be free released at point 62. FIG. 7 shows a cross section through line VII—VII of FIG. 6, showing the barrier 10, preferably extending to the top of impervious layer 36, as well as remediation devices 26. Thus, the method of the invention can also include pumping chemicals an/or water into the contaminated region upstream of the flow 16 of contaminants, where upstream would, for example mean the point 62 in FIG. 7, and pumping groundwater out of the ground downstream of the flow of contaminants as at point or area 60. This combination, to prevent back flow if wells 28 are used or also to allow increased flow of contaminants toward the remediation means can be very beneficial for allowing controlled treatment of the waste stream or plume.

I claim:

1. A method of treating flowable contaminants beneath a surface region in the ground comprising:

freezing at least one, open subsurface barrier volume of earth in the form of a wall structure near the contaminated region, and positioning the frozen barrier such that the flow of contaminants is directed along a predetermined, subsurface path causing concentration of contaminants.

2. The method of claim 1, where the barrier is frozen by use of passing a refrigerant medium through pipes in the earth within the volume of earth where the frozen subsurface barrier is desired.

3. The method of claim 1, where the flow of contaminants is outside of the frozen barrier.

4. The method of claim 1, where at least two barriers are frozen.

5. The method of claim 1, where remediation means are placed in the ground at or near a point of concentration, in order to remove the contaminants.

6. A method of treating flowable contaminants beneath a surface region in the ground, characterized by:

(A) freezing a subsurface barrier volume of earth, having two end portions and a central portion, partly surrounding the contaminated region and vertically extending to an impervious strata layer;

(B) positioning the frozen barrier to allow a flow of contaminants within the subsurface barrier through an opening between the two end portions of the barrier in a manner to concentrate the contaminants; and (C) concentrating the contaminants.

7. The method of claim 6, where the barrier is frozen by use of passing a refrigerant medium through pipes in the earth within the volume of earth where the frozen subsurface barrier is desired.

8. The method of claim 6, where the flow of contaminants is outside of the frozen barrier.

9. The method of claim 6, where remediation means are placed in the ground at or near the point of concentration, in order to remove the contaminants.

10. The method of claim 1, where the frozen barrier extends vertically to the top of an impervious strata layer.

11. The method of claim 1, where chemicals are pumped into the contaminated region near the frozen barrier in an amount effective to enhance migration of contaminants from the earth they permeate.

12. The method of claim 1, where groundwater is pumped into the contaminated area to cause enhanced contaminant migration.

13. The method of claim 1, where groundwater is withdrawn from the ground downstream of the flow of contaminants to induce contaminant migration.

* * * * *